US005160909A

United States Patent [19]

Crow

[11] Patent Number: 5,160,909

[45] Date of Patent: Nov. 3, 1992

[54] STATE INDICATING RELAY

[75] Inventor: Chester H. Crow, Schaumburg, Ill.

[73] Assignee: Appliance Control Technology, Addison, Ill.

[21] Appl. No.: 726,264

[22] Filed: Jul. 5, 1991

[51] Int. Cl.[5] ..... H01H 67/02

[52] U.S. Cl. ..... 335/128; 335/83; 335/17

[58] Field of Search ..... 335/78-86, 335/124, 128, 131, 133, 17

[56] References Cited

U.S. PATENT DOCUMENTS 2,892,058 6/1959 Tancred ..... 335/78

3,209,095 9/1965 Obszarny ..... 335/81

*Primary Examiner*—Lincoln Donovan

*Attorney, Agent, or Firm*—Robert J. Black

[57] ABSTRACT

A state indicating relay wherein a pair of signal contacts connectable to an external electrical circuit are shunted, or opened in response to a bridging contact mounted on the rear of a switching contact mounted on the relay armature. Insulation is provided between the signal/-bridging contacts and the power switching contacts of the relay. Operation of the power switching contacts is indicated by the current state of the signal/bridging contacts.

11 Claims, 1 Drawing Sheet

STATE INDICATING RELAY

BACKGROUND OF THE INVENTION

1. Field of the Invention

The present invention relates to power switching relays and more particularly to a power switching relay including means for indicating the state of the relay contacts with respect to the state of the magnetic coil.

2. Description of the Background Art

A background art search directed to the subject matter of this application in the U.S. Patent and Trademark Office disclosed the following U.S. Pat. Nos. 4,105,882; 4,479,117; 4,567,477; 4,645,886; 4,647,727; 4,854,286.

The first patent, 4,105,882, discloses a pressure actuated reversing switch in which manually exerted pressure causes the electrical contacts to make and break in a staggered sequence. The included complex motion permits power contacts to be broken prior to breaking of the contacts at the other end of an included armature. This arrangement permits a self-cleaning action which assures reliability and long life.

U.S. Pat. No. 4,479,117 discloses an add-on fault indicator for a relay comprising a magnetic reed switch and a lamp connected in series across relay contacts with a reed switch mounted contiguous to the relay coil. The reed switch is operated by the magnetic field when the coil is energized. A normal operation indicator lamp is connected in series with the relay contacts to indicate closure of the latter to energize a load. A fault indicator lamp lights if the contacts do not close when the coil is energized but is shunted by the contacts to remain unlighted when the contacts close properly.

U.S. Pat. No. 4,567,477 discloses a smoke detector indicator with an ON-OFF switch indicator system that permits the audio alarm to be turned off for false alarm situations. It further provides a visual indication that the system is not in operation. The included circuit prevents the alarm from sounding, and a visual indicator associated with the switch provides a visual indication when the circuit is open, and is not visually apparent when the circuit is closed.

U.S. Pat. No. 4,645,886 discloses a switch for providing a safety function when its main contacts are fused or stuck together in the ON position. Each arm has a first end which carries the movable main contact and a second end with spring means which mechanically are coupled to the movable switch arm to bias the movable main contact toward the open position away from engagement with the ON contact. Auxiliary safety contacts positioned proximate to the second end include a safety circuit for deenergizing the main circuit in response to abnormal movement of the second end of the movable switch arm.

U.S. Pat. No. 4,647,727 also discloses a safety switch for automatically interrupting a circuit when its main contacts are fused or stuck together in the ON position. The auxiliary safety contacts become opened in response to abnormal movement of the switch arm under influence of a spring when the actuator is moved to the OFF position.

U.S. Pat. No. 4,864,286 discloses monitoring apparatus for a switch, detecting abnormal operation of the actuating mechanism when actuating a switch such as a power circuit breaker. A normal stroke is taken into calculation against a reference stroke and compared with actually measured characteristic stroke to decide whether the operation of the mechanism is correct.

Relays typically can be considered as open-loop subsystems, meaning that once energy is applied to, or removed from, its electromagnetic coil, the state of the relay contacts cannot be directly determined. Because of this, several problems arise from this open-loop nature which leads to the overall system's inability to detect, respond to, or compensate against relay contact failures.

The first one of these is that instance when the coil winding has been stressed or fractured and becomes electrically open thus preventing the moving contacts from closing. Obviously, this creates performance difficulties for a single-relay system as well as for multi-relay systems in which relays operate in concert or combination.

Similar to the first instance is the failure of the coil drive circuitry. Here, the contacts may remain in their "open" state, or, conversely in the activated state, depending upon the effect of the drive circuitry failure.

Finally, when contact welding occurs, welding being that condition when the electromagnetic coil relinquishes its ability to open the contacts, the contacts remain closed. Not only do the problems mentioned above relating to the open coil or coil drive circuitry failure occur, but safety issues now arise.

An operator may attempt to deactivate a relay and without knowing that the relay contacts have welded or stayed in the closed position may expose himself to a hazardous situation.

If a direct method of detecting relay failure existed, a warning light or annuciator could be used as a means to alert the operator of a problem. In addition, electronics could be developed which intelligently respond to failure modes by, for example, removing power from the system to prevent additional relays from being turned on.

At the present time, two methods are typically utilized to compensate for the open loop nature of relays. The first method is to indirectly sense the contacts state by monitoring the existence or non-existence of the anticipated response to the relay such as a motor turning on or a valve closing. It has been found that usually the system to accomplish this type of feedback is quite expensive. A second method is demonstrated performance reliability of the system to a desired level of confidence. Safety agencies such as the Underwriters Laboratory utilize this method to ensure that relays are capable of working with the particular load device throughout the entire life of the product. Nevertheless, under these conditions failures can still occur.

Accordingly, it is the object of the present invention to provide a relay design incorporating circuitry for an independent, integral indication of the state of its moving contacts and thus provide the necessary feedback required for a closed loop relay system.

SUMMARY OF THE INVENTION

The present invention applies to those systems which utilize electromagnetic coil relays in which system performance, reliability or safety can be enhanced by sensing the true state or position of the relay contacts with respect to the state of the operating electromagnetic coil. A particular application has been found in uses such as electric ranges, or similar household equipment, where it is important to sense if heater coils are turned on or off. If properly sensed by this invention, heater coils can be secondarily deenergized or a warning generated before a fire or other dangerous condition can occur.

The present invention provides a relay with a closed loop feedback method to determine the state of the moving power contacts by incorporating three additional, independent, isolated signal contacts. Two of these contacts are fixed, each attached to a dedicated signal terminal, with the third attached to the arm of the moving power contacts. Thus, the relay of this invention is similar to those currently used in that it has at least one fixed power contact and at least one power contact is movable by being attached to the end of a cantilever spring, usually referred to as the armature.

The travel of the armature is in a plane such that the armature may locate at its extremes, its associated power contacts against the fixed power contacts, or in the alternative, at a specific distance away from the fixed power contacts, with the armature resting against a backstop to limit the movement of the armature away from the pole piece or core of the associated relay coil. Accordingly, these positions are referred to as "closed" and "open", respectively, referring to the relationship between the fixed and the moving power contacts. The armature is of metal and spring-loaded so as to always have a distinct "normal" state, such as "normally closed" or "normally open", depending upon the design, style and requirement of the relay. The above noted terms refer to the state of the power contacts when the relay is in its unpowered state. To change the state of the relay, the electromagnetic coil, isolated from the power contacts, is energized creating a magnetic field which causes the armature to move from its "normal" position to its opposite extreme. Thus, the relationship of the power contacts changes state.

The present new design includes the addition of two additional signal contacts located typically on the backstop. Each of these contacts is electrically connected to an extending terminal. These two signal contacts and their corresponding terminals are isolated with respect to each other. A third signal contact is attached to the armature typically in a position opposite that of the power contact and isolated from the power contact. All three electrical signal contacts are electrically isolated from all other voltages present within the relay. The degree or requirement of this voltage isolation may be determined by the appropriate safety agency or system design requirements. The arrangement of three signal contacts is such that when the relay is in its "open" position, with the cantilever resting against the backstop, the third or bridging signal contact rests against or across both of the first two signal contacts, creating near zero impedance between the signal terminals. As the cantilever returns to its other or closed position, the third or signal bridging contact breaks from the first two signal contacts. Thus, the first two signal contacts become isolated, and a near infinite impedance is created between the two signal terminals. These two impedance states of the signal terminals provide distinct logic levels corresponding to the true state of the moving power contacts. It will be well within the scope of those familiar with the state of the art that lamps or audible annunciators with appropriate power sources of their own may be coupled to the signal terminals and provide either an "on" or "off" indication depending upon the logic arrangement utilized. The contacts may also be utilized to activate intelligent circuitry capable of corrective action(s) as deemed necessary in response to the detected contact state versus the expected contact state.

DESCRIPTION OF THE PREFERRED EMBODIMENT

Figure 1:
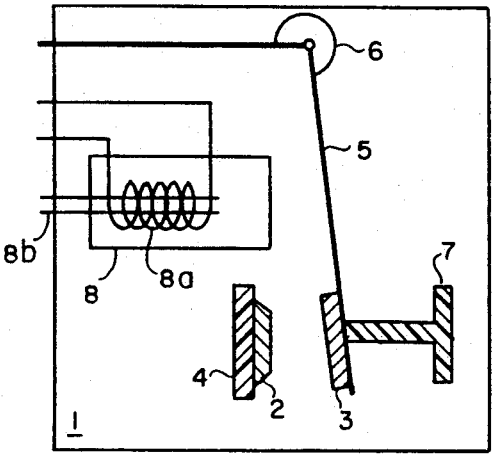
FIG. 1 (PRIOR ART)
FIG. 1 is a view of a typical electromagnetic coil relay used currently for power switching as known in the prior art with its major components shown in the open position.

Referring now to FIG. 1, a prior art normally open electromagnetic coil relay is shown with its power contacts 2 and 3 in the open position. Power contact 2 is mechanically fixed to a stationary beam or position 4, while power contact 3 is mechanically fixed to armature 5. The cantilever spring or armature 5 is spring-loaded my means of spring 6 so as to be normally in a rest position against stationary backstop 7. Thus, an open state relationship can be seen as existing between the power contacts 2 and 3. The spring may be overpowered by energizing the electromagnetic coil 8A, which surrounds core 8B which are parts of relay coil 8. This energization causes the armature 5 to travel in a direction towards the electromagnetic coil 8 and thus close power contacts 2 and 3 so that they assume a position similar to that shown in FIG. 4.

Figure 2:
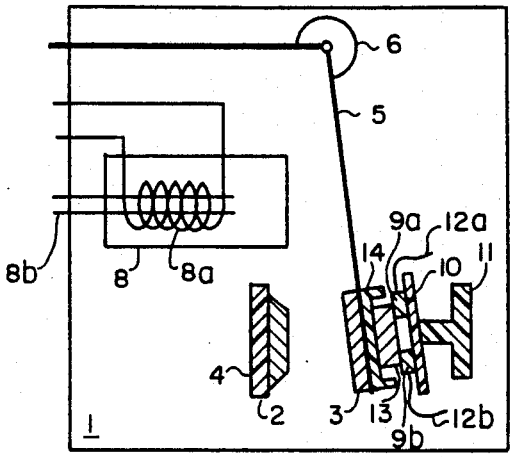
FIG. 2 is a diagramatic view of the improved relay in accordance with the present invention shown in the open position.
Figure 3:
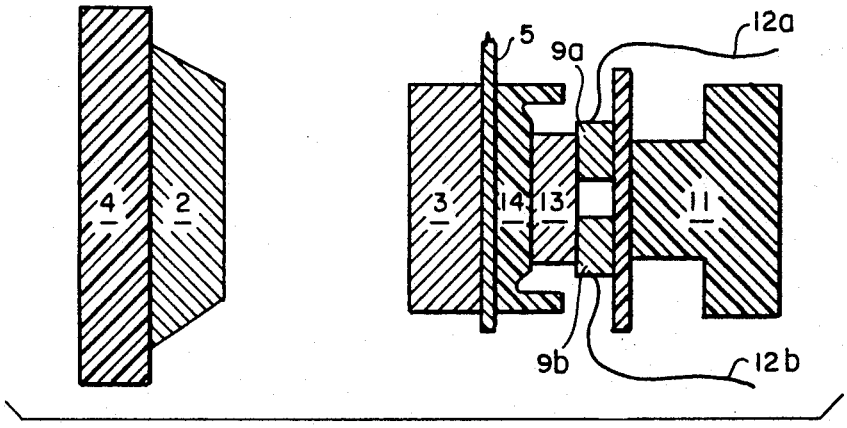
FIG. 3 is an expanded partial view of FIG. 2 detailing the critical contacts and indicating the closure of the power switching and signal contacts as shown when the relay is in its open position.

FIGS. 2 and 3 show the current invention in its open state as may be encountered when the relay is deenergized or the coil 8A is electrically open for some reason or other. The two signal contacts 9A and 9B are fixed to an isolation barrier 10 of electrically insulating material which is affixed to a modified stationary backstop 11. Signal terminal leads 12A and 12B are independently attached respectively to the signal contacts 9A and 9B. These leads may extend then to a power source and an audible or visual annunciator of some sort, or to intelligent circuitry in accordance with techniques well known in the prior art. A third signal bridging contact 13 is fixed to an isolation or insulating barrier 14 which is fixed to the back side of armature spring 5. As may be seen in FIG. 2 or 3, a direct connection resulting in near zero impedance exists between the two signal contacts 9A and 9B. This directly correlates to the open state of power contacts 2 and 3.

Figure 4:
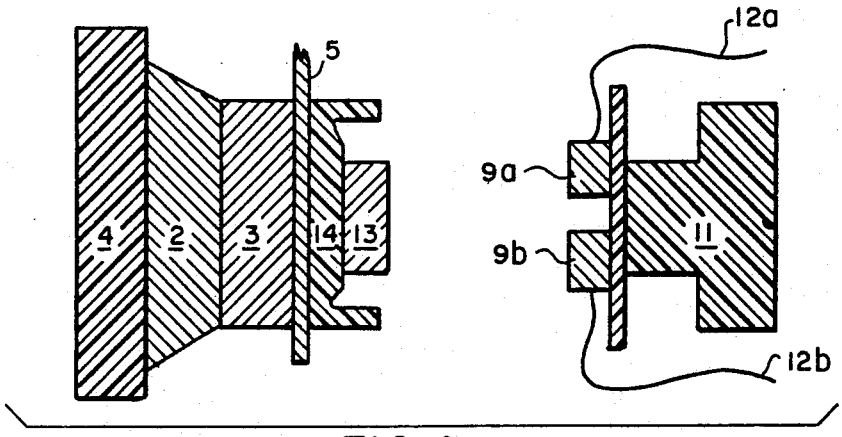
FIG. 4 is also an expanded partial view of FIG. 2 but with the relay power contacts shown in the closed position and the signal contacts shown in the broken or open position.

FIG. 4 outlines and details the complimentary power contact state. Here, as may be seen, the magnetic coil has been energized or contact welding has occurred causing power contacts 2 and 3 to be in the closed or operated position. As may be seen, signal bridging contact 13 has been withdrawn from signal contacts 9A and 9B so that a near infinite impedance exists across the two signal terminal leads 12A and 12B, respectively.

As can be easily seen, normally closed relays would follow a similar approach obvious to those skilled in the art but conversely to the normal open sample shown above (FIG. 4 would then indicate a deenergized or open coil winding or welded contact and FIG. 3 would then indicate that of an energized coil).

It may be easily seen that the approach outlined in the present invention may be directly utilized with multi-pole, multi-contact, and/or multi-state relay subsystems. Obviously, these various combinations will be well within the scope of the present invention. It will be also obvious to those skilled in the art that numerous other modifications may be made without departing from the spirit of the present invention which shall be limited only by the scope of the claims appended hereto.

What is claimed is:

1. A state indicating relay including:

an electromagnet, a stationary switching contact, a movable switching contact, a backstop controlling the limit of movement of said movable switching contact in a direction away from said electromagnet, the improvement comprising:

an insulator mounted on said moving contact;

a pair of signal contacts insulated from each other mounted on said backstop;

a bridging contact secured to said insulator, being insulated from said movable switching contact;

operation of said electromagnet moving said movable switching contact in a direction toward and into contact with said stationary switching contact, or in the alternative moving said movable switching contact away from said stationary switching contact breaking contact between said stationary and movable switching contacts;

said bridging contact, in response to movement of said movable switching contact moving toward said stationary switching contact, breaking electrical contact between said signal contacts, and presenting an infinite impedance between said signal contacts, or in the alternative in response to said movable switching contact being moved away from said stationary switching contact, moving said bridging contact into contact with said signal contacts, establishing a zero impedance condition between said signal contacts.

2. A state indicating relay as claimed in claim 1 wherein:

said backstop is constructed of electrical insulating material.

3. A state indicating relay as claimed in claim 1 wherein:

said signal contacts each include circuit connections connectable to an external signal means.

4. A state indicating relay as claimed in claim 3 wherein:

said circuit connections are connectable to an external audible signal means.

5. A state indicating relay as claimed in claim 3 wherein:

said circuit connections are connectable to a visual signal means.

6. A state indicating relay as claimed in claim 3 wherein:

said circuit connections are connectable to intelligent circuitry capable of initiating appropriate response(s) to detected states of said movable switching contact.

7. A state indicating relay as claimed in claim 1 wherein:

said bridging contact is held away from said signal contacts in response to said movable switching contact becoming welded to said stationary switching contact.

8. A state indicating relay as claimed in claim 1 wherein:

said bridging contact remains engaged with said signal contacts in response to failure of said electromagnetic, or in the alternative to failure of said electromagnetic's drive circuitry.

9. A state indicating relay as claimed in claim 1 wherein:

said movable switching contact is mounted on an armature member constructed of flexible material facilitating the movement of said movable switching contact towards said stationary switching contact, or in the alternative away from said stationary switching contact in response to the operation of said electromagnet, or in the alternative to the release of said electromagnet.

10. A state indicating relay as claimed in claim 9 wherein:

said armature includes biasing means retaining said armature in a fixed position when said electromagnet is unoperated.

11. A state indicating relay as claimed in claim 10 wherein:

said biasing means consist of a spring.

* * * * *